United States Patent [19]

Stewart

[11] Patent Number: 4,591,069

[45] Date of Patent: May 27, 1986

[54] MAGAZINE DISPENSING APPARATUS

[76] Inventor: Jeffrey A. Stewart, 19 Wishing Well Drive, Agincourt, Ontario, Canada, M1T 1H9

[21] Appl. No.: 551,710

[22] Filed: Nov. 14, 1983

[51] Int. Cl.[4] ..... G07F 11/00

[52] U.S. Cl. ..... 221/6; 221/14; 221/129; 221/133; 221/231; 221/241; 221/253

[58] Field of Search ..... 221/6, 13–14, 221/124, 129–131, 133, 195, 231, 241, 242, 253, 277

[56] References Cited

U.S. PATENT DOCUMENTS

| | | | |
|---|---|---|---|
| 1,640,285 | 8/1927 | Mortka | 221/253 |
| 1,670,797 | 5/1928 | Carlson . | |
| 3,160,315 | 12/1964 | Stone et al. | 221/129 X |
| 3,262,603 | 7/1966 | Schendorf et al. . | |
| 3,655,092 | 4/1972 | Hall et al. | 221/133 |
| 3,790,027 | 2/1974 | Barnhart . | |

FOREIGN PATENT DOCUMENTS

| | | | |
|---|---|---|---|
| 3048585 | 7/1982 | Fed. Rep. of Germany | 221/129 |
| 1286847 | 8/1972 | United Kingdom | 221/13 |
| 166193 | 11/1964 | U.S.S.R. | 221/129 |

*Primary Examiner*—Charles A. Marmor
*Attorney, Agent, or Firm*—Ridout & Maybee

[57] ABSTRACT

Magazine dispensing apparatus has a housing with a delivery opening disposed in a lower region of a front wall of the housing. A number of selectively actuatable dispenser units are disposed within the housing. Each has a lower platform and a supporting structure for supporting and retaining a stack of magazines. The platform is formed with a forwardly and rearwardly extending slot through which runs the upper flight of an endless conveyor on which an ejector bar is connected. When the conveyor is actuated, it sweeps the ejector bar forwardly along the platform, displacing the lowermost magazine forwardly until it is free of the stack and falls freely downwardly to a chute which passes it to the delivery opening. The dispenser units can be disposed within the housing well above the delivery opening, and the ejector member passes only once through the dispenser unit with each dispensing cycle, so that access of rain or snow to the magazines and risk of the cover of a magazine being abraded by the ejector bar is prevented or reduced.

8 Claims, 4 Drawing Figures

MAGAZINE DISPENSING APPARATUS

The present invention relates to a magazine dispensing apparatus, and more particularly to an apparatus which is readily adaptable to the dispensing of magazines therefrom on application of a value item or items such as coins, tokens, or magnetically-encoded cards such as magnetically-encoded credit cards.

The inventor is aware of prior proposals for dispensing magazines and other flat items such as maps and books. The prior apparatus has, however, relied on an ejector member reciprocable beneath a stack of the magazines or other items supported within the apparatus. On its forward stroke, the ejector member engages the rear edge of the lowermost item, and dislodges it partially from the stack, causing the front edge of the item to be protruded through a delivery opening in the front wall of the housing of the apparatus, from which it can be withdrawn by the user. On its return stroke, the ejector member rides under the lower surface of the next adjacent item, toward a rearward position in which the ejector member engages the rear edge of the next item, ready for the next dispensing stroke. One disadvantage of this arrangement is that it requires that the stack of items be positioned adjacent to the delivery opening in the front wall of the apparatus, so that these are vulnerable to tampering or to vandalism and further the items are prone to being damaged by ingress of rain or snow through the delivery opening. Further, in each dispensing operation, the ejector member rides under the surface of the preceding magazine in the stack both on the forward and on the rearward stroke of the ejector member, thus increasing the risks of the magazine becoming abraded or torn by its contact with the ejector member.

In the present invention there is provided magazine dispensing apparatus comprising a housing having a front wall; a magazine dispenser unit supported within the housing and comprising a platform, guide means extending upwardly therefrom for supporting a stack of magazines and including retainer means for retaining the front portion of upper magazines in the stack and defining an opening extending adjacent the front of the platform, a slot extending forwardly and rearwardly in the platform, an endless conveyor disposed beneath the platform and having an upper flight of the conveyor within the slot, an ejector member mounted on the conveyor and extending laterally therefrom and sweeping out a path along the upper surface of the platform adjacent the slot when the conveyor rotates, and means for energising the conveyor to rotate it in a direction sweeping the ejector member forwardly along the platform, whereby the ejector member can engage a lowermost magazine of a stack of magazines when supported on the platform and drive the magazine forwardly from the unit through said opening so that the magazine falls freely from the front of the unit; a delivery opening in the front wall of housing below said unit; and a delivery chute disposed between the unit and the delivery opening and positioned for receiving a magazine falling freely from the unit and for guiding it to the delivery opening.

With this arrangement, the ejector member traverses the face of the adjacent magazine only once in each dispensing operation, thus reducing the risk of damaging the magazines stored in the apparatus, while the forward motion of the ejector member can sweep the magazine being dispensed completely clear of the stack so that it falls freely toward the delivery opening. This permits the stack of magazines to be located at a position remote from and above the delivery opening, so that risks of tampering with the magazines in the stack or of damage to the latter through ingress of moisture such as rain or snow through the delivery opening can be greatly reduced.

An embodiment of the present invention will now be described in more detail, by way of example only, with reference to the accompanying drawings, in which.

With reference to the drawings, the dispensing apparatus has a sturdy metal rectangular box-like housing 10 which encloses the top, bottom, sides and back of the apparatus. The front is normally closed by a cover door 11 hinged to one side. The door 11 forms a weather-tight closure for the housing 10. A number of magazine dispenser units are supported within the housing 10. In the example shown, there are three vertically spaced shelves 12, 13, and 14 connected within the housing. Each of the shelves supports two magazine dispensing units 16.

Figure 3:
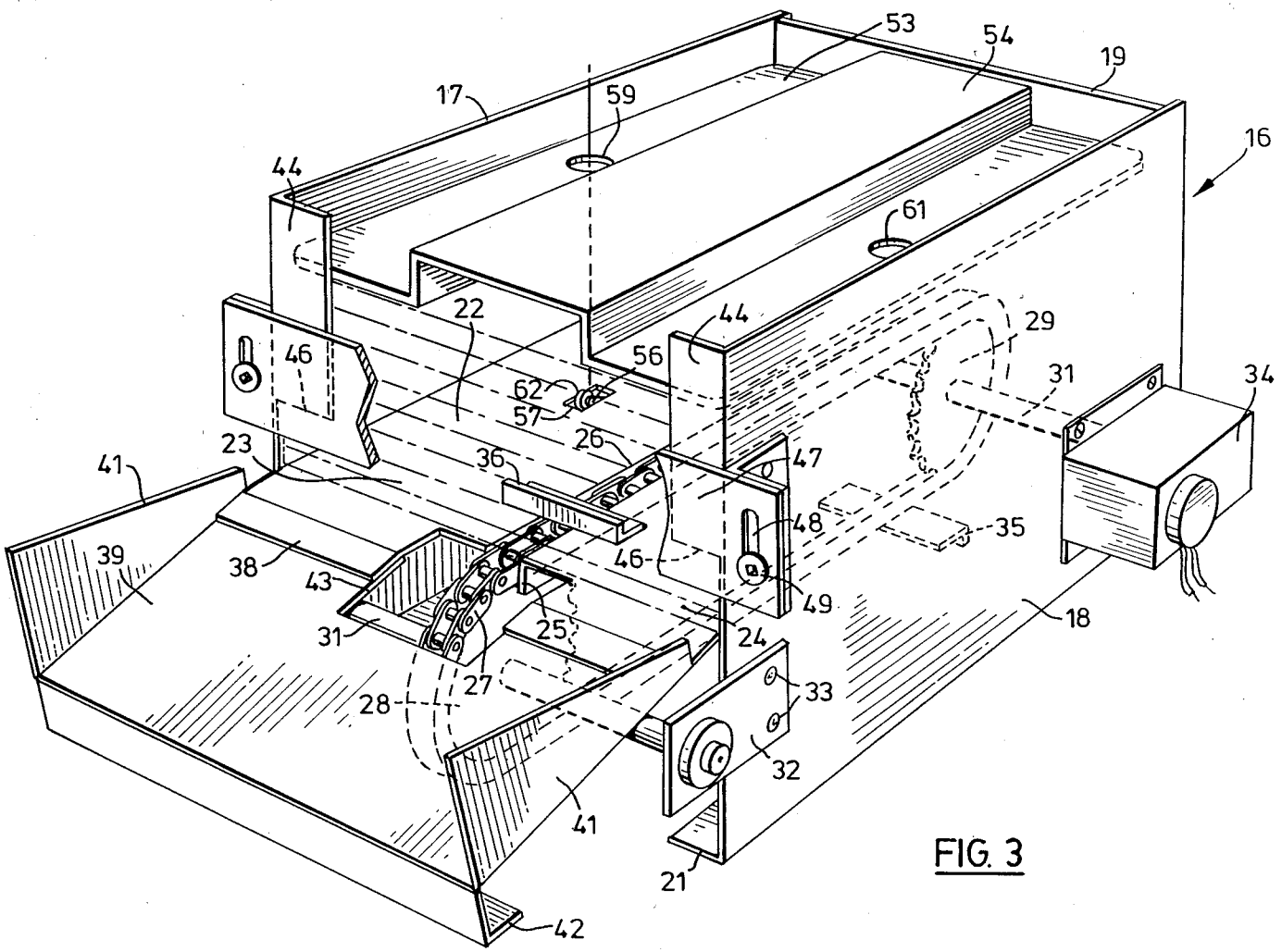
FIG. 3 is a fragmentary perspective view of a dispenser unit of the apparatus.
Figure 4:
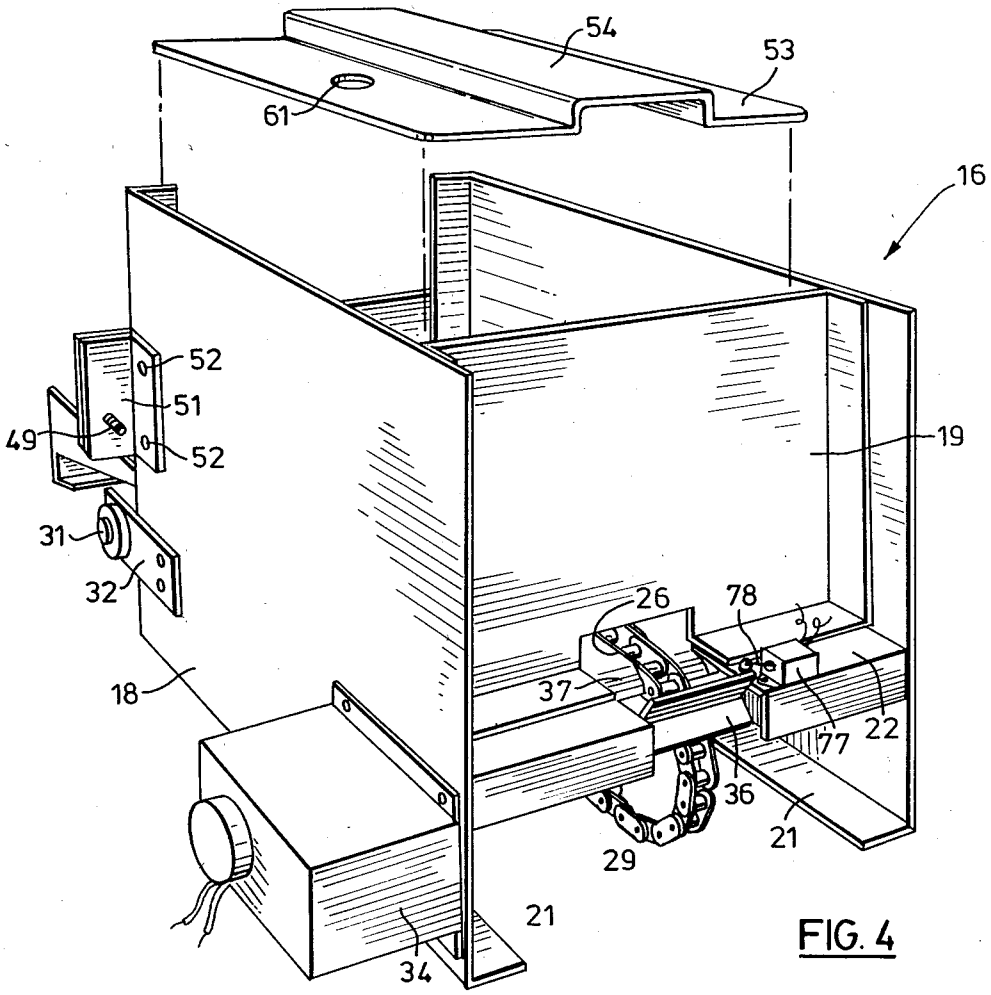
FIG. 4 is a rear view of the unit of FIG. 3.

As shown in more detail in FIGS. 3 and 4, each dispenser unit 16 comprises a metal generally rectangular box-like support structure having sides 17 and 18 and a rear wall 19. The lower edge of each side wall 17 and 18 has an inturned edge portion 21 through which screws may be passed to anchor each unit to the shelf 12, 13 or 14 on which it rests. A platform member 22 extends horizontally within each dispenser unit 16. The platform 22 may be for example of sheet metal and may be united e.g. by welding at its edges to the sides 17 and 18 and to the rear wall 19. In the example shown, the platform 22 is formed from two distinct pieces 23 and 24, one united to the side wall 17 and the other to the side wall 18. Adjacent edges of the portions 23 and 24 are formed with downwardly-depending spaced, parallel edge flanges 25 defining between the a forwardly and rearwardly extending slot 26. However, instead of being formed by two separate portions 23 and 24, the platform 22 may be formed from a continuous piece which may be formed with a channel section depression, the bottom wall of the channel being recessed below the general plane of the platform 22, and the channel walls defining between them an elongate slot which is open at its upper side. Within the slot 26 runs the upper flight of an endless chain link conveyor 27 passing over front and rear sprockets 28 and 29. The sprockets 28 and 29 are connected on transversely extending shafts 31 journalled at their ends in the side walls 17 and 18 of the support structure or in extensions 32 secured thereto by fasteners 33. The shaft 31 of the rear sprocket 29 is connected to and driven by a motor 34 secured on the side wall 18 of the housing and arranged to rotate the shaft 31 and the sprocket 29 in the sense causing the upper flight of the conveyor 27 to traverse the platform 22 from its rear toward its front. At least one ejector member is mounted on the conveyor 27. In a dispensing cycle of the unit, the ejector member is swept forwardly along the platform 22 and engages the rear edge of the lowermost magazine held in the unit and ejects the magazine forwardly from the stack. Preferably, as shown, the conveyor is provided with two ejector members 35 and 36, so that two dispensing cycles can be performed for each complete revolution of the conveyor 27. The spacing between the members 35 and 36 should be at least equal to the length of the upper flight of the conveyor 27 exposed in the slot 26. Conveniently, the members 35 and 36 can be disposed at a spacing approximately half the total loop length of the endless conveyor 27. Each ejector member is secured to a respective link of the chain 27, e.g. by welding, and preferably in the form of is an angle-section ejector bar extending transversely of the chain link conveyor. In operation, when the motor 34 is energized, the bars 35 and 36 are swept successively along the upper surface of the platform 22. Desirably, the sprockets 28 and 29 and the chain link conveyor 27 are arranged so that the latter in its upper flight is recessed downwardly beneath the upper surface of the platform 22 and thus does not come into contact with the lowermost of a stack of magazines received within the support structure. Each ejector bar 35 and 36 is arranged at a clearance from the link to which it is secured slightly more than the thickness of the material of the platform 22, so that the ejector bar 35 or 36 can traverse the platform 22 without binding on its upper surface. Desirably, as shown, the leading edge of each ejector bar 35 and 36 which faces forwardly in its movement along the upper flight of the conveyor 27 extends upwardly and transversely of the chain link conveyor, to provide a surface which, on movement of the bar 35 or 36 forwards from a rear position shown in FIG. 4, will engage snugly the rear edge of the lowermost of a stack of magazines supported in the support structure. The upward extent of this front edge of the bar 35 or 36 is made slightly less than the thinnest magazine which is intended to be dispensed from the apparatus, so that the bar 35 or 36 will not engage the rear surface of the next magazine in the stack. As best seen in FIG. 4, adjacent the rear end of the slot 26, the edges of the platform portions 23 and 24 are curved downwardly and rearwardly to form a curved ramp surface 37 over which the lower edge of the bars 35 and 36 may ride with some small clearance at the point where they pass upwardly and forwardly over the rear sprocket 29.

As seen in FIG. 3, desirably the front edge portion 38 of the platform 22 extends forwardly beyond the front edges of the side walls 17 and 18 of the support structure and slopes downwardly and forwardly, so that a magazine displaced from the stack by the ejector bar 35 or 36 can slide forwardly and downwardly over this inclining portion 38 under the influence of gravity. Desirably, a forward extension or apron 39 is connected to the front edge portion 38 of the platform 22, preferably by having its rear edge welded to the underside of the front edge of the edge portion 38 as shown. The apron 39 also slopes downwardly and forwardly, so as to guide forwardly toward the chute structures, described in more detail below, a magazine displaced from the stack and falling freely from the front of the dispenser unit. The apron 39 may be provided with an upstanding wall 41 at each side, so as to guide forwardly any magazine which may tend to become skewed relative to the stack while being dispensed. The front edge of the apron 39 may be provided with a downwardly and rearwardly directed extension 42 which closes the gap between the front edge of the apron 39 and the upper surface of the adjacent shelf 12, 13, or 14, on which the unit 16 is supported, to close off access to the mechanism underneath the platform 22 and to reduce risk of items such as magazines being introduced into the space underneath the platform 22 where they might engage the mechanism and cause jams.

The front portion of the platform 22 and the adjacent portion of the apron 39 are formed with an aperture 43 sufficiently large that the ejector bars 35 and 36 can pass freely downwardly through it as they pass downwardly and forwardly over the front sprocket 28 toward the lower flight of the chain link conveyor 27.

The front edges of the side walls 17 and 18 each have an inwardly transversely directed wall portion 44 which serves to retain the front edges of upper magazines when stacked on the platform 22. Each wall portion 44 has a lower edge 46 spaced upwardly from the upper surface of the platform 22, to provide an opening through which the lowermost of the magazines in the stack may be dispensed forwardly. In order to ensure that only a single magazine is dispensed in each dispensing operation, a control device, described in more detail below, is provided which de-energises the motor 34 after each single sweep of an ejector bar 35 or 36 along the platform i.e. after each half revolution of the conveyor 27. Further, an adjustable retainer bar 47 is provided which extends across the full width of the opening defined between the platform and the lower edges 46, so that the bar 47 engages the end surface including the lateral edges of the magazine next upwardly adjacent the lowermost magazine in the stack. In the example shown, the retainer bar 47 has at each end a vertically elongated slot 48. A screw 49 is passed through each slot 48, and is threaded in an aperture in a supporting bracket 51 connected on the side of the adjacent side wall 17 or 18 by fasteners 52. With this arrangement, when the screws 49 are loosened, the retainer bar 47 can be adjusted vertically so that its lower edge defines with the upper surface of the platform 22 an opening slightly larger than the thickness of a single copy of the magazines stacked in the unit. When the lowermost magazine is ejected forwardly from the unit by the ejector bar 35 or 36, the lower edge of the retainer bar 47 engages the front edge of the next adjacent magazine in the stack and retains this from being ejected from the stack until the next dispensing cycle is commenced.

Desirably, a weight member is provided which rests on the top of the stack of magazines, and applies a downward compressive force on the stack of magazines, to overcome the frictional forces between the edges of the magazines and the side and rear walls 17, 18 and 19, and to ensure that, when an ejector bar 35 or 36 has traversed the platform 22 and has ejected a magazine, the stack of magazines settles downwardly with the next magazine resting firmly on the platform 22. In the example illustrated, the weight member is in the form of a rectangular plate 53 of heavy gauge metal dimensioned to fit with some clearance within the side and rear walls 17, 18 and 19. The central portion 54 of the plate 53 is offset upwardly to provide a downwardly-opening channel 55 extending forwardly and rearwardly in alignment with the slot 26. The channel 55 is of sufficient width and depth for the ejector members 35 and 36 to pass freely through it when dispensing the last magazine from the unit, at which point the weight member 53 rests on the platform 22. The channel 55 also provides a hand grip facilitating lifting the weight member 53 when it is desired to replenish the stack of magazines in the unit.

An electrical switch is supported on the underside of the platform 22 and has a plunger 56 extending in an opening 57 in the platform 22. The plunger 56 is provided with resilient means biasing it upwardly from a non-actuating condition of the switch to an upper position in which the switch is actuated. Normally, when one or more magazines are present in the dispenser unit 16, the weight of the magazines maintains the plunger 56 depressed downwardly to the non-actuating position. When the last magazine has been dispensed from the unit, downward pressure is no longer exerted on the plunger 56, which then pivots upwardly to the actuating condition of the switch. The switch, which functions as an "empty" switch, is connected electrically to an indicator unit 58 on the door 11 of the housing and, in its actuating condition, illuminates a "SOLD OUT" indicator on the exterior of the unit 58 and visible from the front of the door 11. Where, as in the example illustrated, there are a number of separate dispenser units 16 within the housing 10, a corresponding number of illuminable indicators are provided on the indicator unit 58, and each of the units 16 is provided with an empty switch as described, each switch being coupled to a respective illuminable indicator in the indicator unit 58.

Each weight member 53 is provided with a recess or through aperture 59 positioned in register with the plunger 56 of the empty switch, so that when the last magazine has been dispensed from the unit, and the member 53 rests on the platform 22, the plunger 56 extends upwardly into the aperture 59, so that the member 53 does not interfere with movement of the plunger 56 upwardly to its actuating position. Desirably, the weight member is formed with a further aperture 61, the apertures 59 and 61 being positioned symmetrically with respect to the centre of the member 53, so that if, after replenishing the unit with a stack of magazines the operator inadvertently places the weight member 53 in the dispenser unit with the aperture 59 on the side opposite the plunger 56 of the empty switch, the aperture 61 will be in registry with the plunger 56 of the empty switch, and thus the weight member will not interfere with the functioning of the empty switch.

The upper end of the plunger 56 is desirably provided with an anti-friction member e.g. a smooth plastic cap or button, or a freely-rotating roller 62 as shown, so that as a magazine is dispensed from the unit, its lower surface glides freely over the member 62, to avoid or reduce risk of the plunger 56 abrading or tearing the lower face of the magazine.

A delivery opening 63 is formed in the door 11, through which magazines dispensed from the apparatus are delivered to the user. The opening 63 is in the form of a transversely elongated slot disposed some distance below the lower dispenser units 16 supported on the lowermost shelf 14 within the housing 10.

Figure 1:
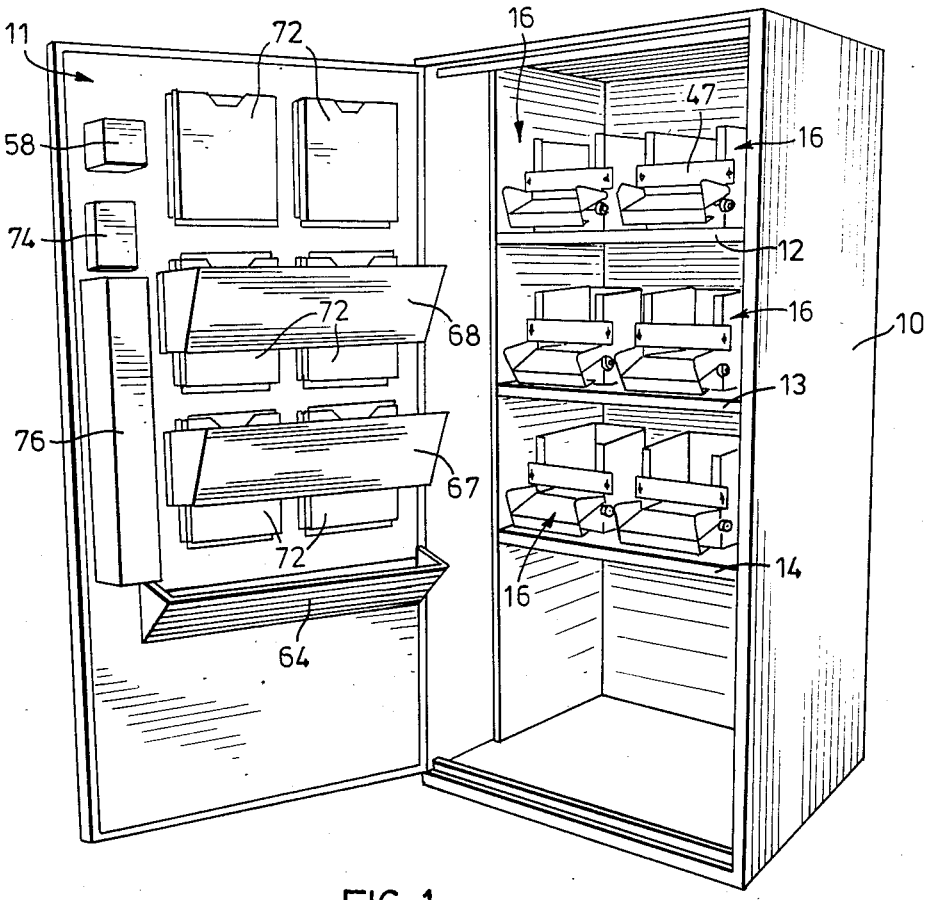
FIG. 1 is a perspective view of magazine dispensing apparatus in accordance with the invention, with a front door of the apparatus in open position, showing the interior structure.
Figure 2:
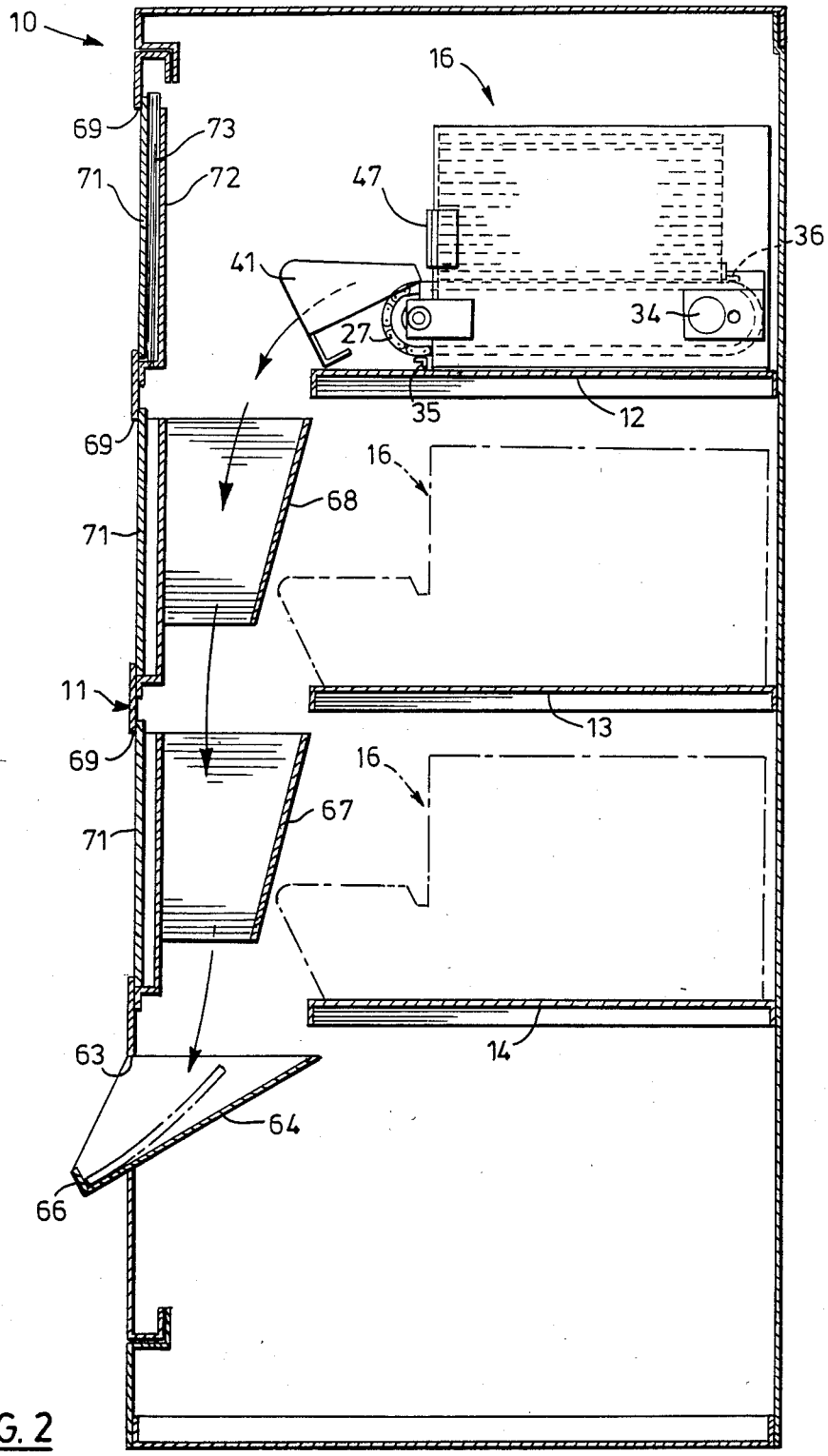
FIG. 2 is a partially schematic vertical cross-section through the apparatus of FIG. 1 with the door in closed position.

Within the opening 63 is mounted an upwardly and rearwardly inclining lower chute 64. In the closed position of the door 11, as shown in FIG. 2, the rear edge of the chute 64 extends beneath the front edge of the shelf 14. The dispenser units 16 are positioned on the shelves 12, 13, and 14 with the front edges of their aprons 39 arranged approximately in register with the front edge of the respective shelf 12, 13 or 14, so that magazines passing downwardly and forwardly over the aprons may fall freely beyond the front edge of the shelf. In particular, magazines dispensed from either of the two lower units 16 disposed on the lower shelf 14 fall direct into the lower chute 14. The front edge of the lower chute 64 protrudes forwardly through the opening 63 a small distance beyond the front face of the door 11, and terminates in an upwardly and forwardly extending lip 66, so that magazines falling into the chute 64 are retained by the lip 66 in a position, as shown in broken lines in FIG. 2, from which they can be readily retrieved by the user. An intermediate chute 67 is mounted on the rear face of the door 11 e.g. by laterally extending edge portions welded to the new face of the door 11. The chute 67 is arranged so that, in the closed position of the door, as shown in FIG. 2, it receives magazines dispensed from either of the two intermediate dispenser units 16 which are supported on the intermediate shelf 13. The intermediate chute 67, as best seen in FIG. 2, has an upwardly and rearwardly inclining rear wall, the upper edge of which in the closed position of the door 11 extends approximately in register with the front edge of the intermediate shelf 13. The chute 67 is open at the top and at the bottom, so that magazines falling into it are guided downwardly into the lower chute 64. Similarly, an upper chute 68, also open at the top and at the bottom, is mounted on the rear face of the door 11 above the intermediate chute 67 in a position to receive magazines dispensed from either of the top two dispenser units 16 supported on the upper shelf 12, and to guide these downwardly to the intermediate and lower chutes 67 and 64.

Normally, each of the dispenser units within the housing 10 will be stocked with a different magazine, thus providing the user with a choice of magazines which the user may wish to obtain from the apparatus. To assist the user in selection of a particular magazine to be dispensed, the magazines available are displayed through window openings 69 in the door 11. As best seen in FIG. 2, each window opening 69 is provided with a transparent cover 71. A receptacle is formed rearwardly of each cover 71 by a plate member 72 which is secured, e.g. by welding laterally extending edge portions, along the bottom edge and along each side edge to the rear surface of the door 11, thus forming an open topped receptacle or pocket into which the operator of the machine can insert a display sample of a magazine e.g. as illustrated at 73 in FIG. 2. For the convenience of operators of the apparatus the display windows 69 and pockets 72 are disposed in an arrangement corresponding to the arrangement of the units 16 within the machine, i.e. in this example in three vertically spaced rows of two, and when the operator loads a stack of magzines into a particular dispenser unit 16, the operator inserts the display sample into the pocket 72 corresponding in position to the dispenser unit 16.

Also provided on the door 11 of the housing is a selector unit 74 and a value item receiving unit 76. On the front surface of the door 11 i.e. on the side exposed to the user, the selector unit 74 provides an array of selector members e.g. keys or push buttons, disposed in an arrangement corresponding to the arrangement of the dispenser unit 16 and of the pockets 72 i.e. in this example in three vertically spaced rows each of two. Each selector member on the selector unit 74 is operatively connected to the motor 34 of a respective dispenser unit 16 through the value item receiving unit 74. Thus, the selector unit 74 is subjugated to the control of the receiving unit 76. When an appropriate value item is applied to the receiving unit 76, this energises the selector unit 74 and permits the user to actuate a desired dispenser unit 16, by depressing a selector member of the selector unit 74 thus leading to dispensing of the desired item from the apparatus. For the convenience of the user of the apparatus, each selector member on the selector unit 74 is coupled electrically through the receiving unit 76 to the dispenser unit 16 which corresponds in position to the position of the selector member on the face of the selector unit 74 thus, for example, if the user desires the magazine which is maintained in the upper right hand dispenser unit 16 within the housing 10, and a sample copy of which is displayed in the upper right hand pocket 72 in the door 11, the user depresses the selector member which is the upper right hand member of the array of selector members on the unit 74 on the outer face of the door 11. The value item receiving unit 76 may be a coin or token operated mechanism or a mechanism adapted to be actuated by application of a magnetically encoded card e.g. a credit card. The door 11 is provided with a slot or slots through which coins, tokens, or cards may be inserted and introduced into the receiving unit 76. The nature of the components suitable for use as the selector unit 74 and as the value item receiving unit 76 and of the electrical connections therebetween and with the power source and the motors 34 of the dispenser units 16 will be readily apparent to those skilled in the art, and need not be described in detail herein. In outline, when the user applies an appropriate value item or combination of items to the receiving unit 76, and actuates a selector member on the selector unit 74, electrical connections between the selector unit 74, the receiving unit 76 and the motors 34 of the dispenser units 16 cause electrical power to be applied to the motor 34 of the corresponding dispenser unit 16, rotating the sprocket 29 to drive the chain link conveyor 27, through one complete revolution. This causes the ejector member 35 or 36, which at the start of the operation is in the rearward position shown in FIG. 4, rearwardly of the platform 22, to sweep forwardly along the slot 25, around the front sprocket 28, along the lower flight of the conveyor 27, and to restore it to its rearward position as illustrated in FIG. 4. A control device is associated with the conveyor 27 and motor 34 to ensure that after one-half revolution of the conveyor, the motor 34 is de-energized until a further value item or combination of value items is applied to the receiving unit 76 and the selector member on the unit 74 corresponding to that dispenser unit 16 is again actuated. Such control device may comprise, for example, a switch 77 mounted on the rear edge of the platform 22 and having an armature 78 positioned to be contacted by the ejector bar 35 or 36 at the point where this passes upwardly and forwardly over the rear sprocket 29, as shown in FIG. 4. The switch 77 is connected through appropriate electrical components and circuitry, the nature and arrangement of which will be readily apparent to those skilled in the art, to provide that, when the switch is actuated by contact with the ejector bar 35 or 36 at the end of a dispenser cycle, the motor 34 is de-energized until a value item is applied to the receiving unit 76 and the selector member on the selector unit 74 associated with that particular dispenser unit 16 is again actuated, whereupon the dispensing cycle can again proceed until the motor is again de-energised on re-actuation of the switch 77 by contact with the succeeding ejector bar 35 or 36 following a further half revolution of the conveyor 27.

As will be appreciated, with each dispensing cycle, the ejector bar 35 or 36, as it travels forwardly over the slot 25, engages the rear edge of the lowermost magazine in the stack, and pushes this forwardly through the opening below the retainer bar 47 until the rear edge of the magazine is well clear of the stack of magazines retained in the dispenser unit. Once the magazine is freed from its contact with the remaining magazines in the stack, it falls freely downwardly over the apron 39 and downwardly toward one or more of the chutes 64, 67 and 68 to the position indicated in broken lines in FIG. 2, where it is retained within the delivery opening 63 by the lip 66 from where it may be retrieved by the user.

I claim:

1. Magazine dispensing apparatus comprising a housing having a front wall; a plurality of magazine dispenser units within said housing; each unit comprising a platform, guide means extending upwardly therefrom and supporting a stack of magazines, retainer means for retaining the front portion of upper magazines in the stack and defining an opening extending adjacent the front of the platform and comprising an inwardly directed wall portion spaced above each side of the front edge of the platform, a member extending transversely across the width of the opening and engaging the end surface including the lateral edges of the magazine next upwardly adjacent the lowermost magazine in the stack, and means supporting the ends of said member whereby the spacing between the member and the front edge of the platform may be adjusted, a slot extending forwardly and rearwardly in the platform, an endless conveyor disposed beneath the platform and having an upper flight of the conveyor within the slot, an ejector member mounted on the conveyor and extending laterally therefrom and sweeping out a path along the upper surface of the platform adjacent the slot when the conveyor rotates, and means for energising the conveyor to rotate it in a direction sweeping the ejector member forwardly along the platform, whereby the ejector member can engage the lowermost magazine and can drive the magazine forwardly from the unit through said opening so that the magazine falls freely from the front of the unit; said units being spaced at differing vertical levels in the housing; a delivery opening in the front wall of the housing below the or each lowermost unit; a delivery chute disposed between the or each lowermost unit and the delivery opening and positioned for receiving a magazine falling freely from a lowermost unit and for guiding it to the delivery opening; and upper chute open at its upper and lower ends positioned for receiving a magazine dispensed from the or each unit spaced above said lowermost unit or units and for guiding it toward the delivery chute; and means for selectively energizing the conveyor of each unit independently of that of each other unit.

2. Apparatus as claimed in claim 1 wherein each unit includes an apron extending forwardly and downwardly from the front edge of the platform and having an aperture therein through which the ejector member passes downwardly as it moves toward the lower flight of the conveyor.

3. Apparatus as claimed in claim 2 wherein the apron has an upstanding wall at each side.

4. Apparatus as claimed in claim 1 wherein a surface of the ejector member which faces forwardly in its movement along the upper flight of the conveyor extends upwardly from and transversely of the conveyor.

5. Apparatus as claimed in claim 1 wherein each unit includes a switch member disposed in an opening in the platform and movable from an actuating position to a non-actuating position by pressure of the weight of one or more magazines supported on the platform, means biasing the switch member toward the actuating position, and indicator means on the front wall of the housing actuated by movement of the switch member from its non-actuating position to the non-actuating position.

6. Apparatus as claimed in claim 5 including a weight member adapted to rest freely on the uppermost magazine of said stack, and having a recess therein in register with the switch member whereby the switch member is received in the recess in actuating position when the last magaaine has been dispensed from the stack.

7. Apparatus as claimed in claim 6 wherein the weight member is provided with a downwardly opening channel in alignment with the path of the ejector member over the platform through which channel the ejector member can travel freely when the weight member rests on the platform.

8. Apparatus as claimed in claim 1 wherein two of said ejector members are mounted on the conveyor of each unit at a spacing along the length of the conveyor at least equal to the length of the path swept by each member along the platform, and including control means responsive to movement of the conveyor and adapted to be actuated to de-energise the conveyor when either of said ejector members is at a position adjacent the rear end of the slot in the platform and means for re-energising the conveyor until the control means is again actuated.

* * * * *